United States Patent [19]

Okazaki et al.

[11] Patent Number: 4,856,469

[45] Date of Patent: Aug. 15, 1989

[54] MECHANICAL PARTS OF VALVE DRIVING MECHANISM FOR INTERNAL COMBUSTION ENGINE

[75] Inventors: Ken Okazaki; Kazuo Satou, Higashi-Hiroshima; Junichi Yamamoto, Hiroshima, all of Japan

[73] Assignee: Mazda Motor Corporation, Hiroshima, Japan

[21] Appl. No.: 247,639

[22] Filed: Sep. 22, 1988

[30] Foreign Application Priority Data

Sep. 25, 1987 [JP] Japan ..... 62-240260

[51] Int. Cl.[4] ..... F01L 1/04

[52] U.S. Cl. ..... 123/90.51; 123/90.6

[58] Field of Search ..... 123/90.51, 90.6, 90.17

[56] References Cited

U.S. PATENT DOCUMENTS

| | | | |
|---|---|---|---|
| 4,153,017 | 5/1979 | Behnke | 123/90.51 |
| 4,360,383 | 11/1982 | Takahashi et al. | 75/246 |
| 4,491,477 | 1/1985 | Suganuma et al. | 419/11 |
| 4,518,563 | 5/1985 | Suganuma et al. | 419/29 |
| 4,583,502 | 4/1986 | Takahashi et al. | 123/90.51 |
| 4,790,875 | 12/1988 | Urano et al. | 419/47 |

FOREIGN PATENT DOCUMENTS

| | | | |
|---|---|---|---|
| 553422 | 1/1980 | Japan . | |
| 0180708 | 10/1983 | Japan | 123/90.6 |
| 0037215 | 2/1984 | Japan . | |
| 0037216 | 2/1984 | Japan . | |
| 0037217 | 2/1984 | Japan . | |
| 2073247 | 10/1981 | United Kingdom | 123/90.51 |

*Primary Examiner*—Charles J. Myhre
*Assistant Examiner*—Weilun Lo
*Attorney, Agent, or Firm*—Fleit, Jacobson, Cohn, Price, Holman & Stern

[57] ABSTRACT

A valve driving mechanism of which a rocker arm is provided at one end portion with a roller brought into a rotative contact with a cam surface of a cam for driving engine valves. The cam consists of 2.0–4.0 wt % of C, 1.5–3.5 wt % of Si, 0.1–1.0 wt % of Mn, 0.005–0.08 wt % of Mg, less than 0.15 wt % of P, less than 0.15 wt % of S, 0.3–1.0 wt % of Cu, 0.03–0.09 wt % of Mo with the balance of Fe, with a matrix of the cam being a granular graphite cast iron having a mixed structure of 30–50 vol % of residual austenite structure and a bainite structure.

4 Claims, 3 Drawing Sheets

MECHANICAL PARTS OF VALVE DRIVING MECHANISM FOR INTERNAL COMBUSTION ENGINE

BACKGROUND OF THE INVENTION

1. Field of the invention

The present invention relates to a valve driving mechanism for an internal combustion engine, more specifically to mechanical parts employed for the valve driving mechanism.

2. Description of the Prior Art

In a valve driving mechanism for an internal combustion engine, there has been known a structure having a rocker arm provided at one tip end portion with a roller which is brought into a contact with a cam surface of a cam. With this structure, the roller rotates as it contacts with the cam surface so that a wear amount of the cam and the roller can be reduced in comparison with a structure in which a tip end of rocker arm slidably contacts with a cam surface because a friction coefficient by rolling is smaller than that by sliding. As a result, the structure provided with the roller at the tip end of the rocker arm can improve a durability of the valve driving mechanism.

It should however be noted that, in the valve driving mechanism having the rocker arm provided with the roller, the parts of the mechanism are required to have an improved pitting resistance property as well as an improved wear resistance property.

For this purpose, conventionally, a cam shaft having a cam portion of a chilled structure has been proposed. This cam shaft is advantageous in wear resistance and heat resistance properties because of the chilled structure of a high hardness formed on the cam surface portion but insufficient in pitting resistance property.

A forged cam is also conventionally known. This type of cam shaft is provided after a heat treatment such as induction hardening, carburizing and the like. This cam shaft is advantageous in the pitting resistance property but disadvantageous in manufacturing cost. In addition, it is impossible to get a hollow cam structure through a forging process so that the forged cam is disadvantageous in weight.

Japanese Patent Publication No. 55-3422, published on Jan. 25, 1980, discloses a ductile cast iron consisting of 3.2–4.0% of C, 1.5–5.0% of Si, less than 0.08% of P, less than 0.02% of S, 0.02–0.08% of Mg, 0.10–0.26% of Mo, 0.3–1.4% of Mn with the balance of Fe in weight and the cast iron being formed by a bainite structure including 20–50% in volume of residual austenite structure. However, even if mechanical parts of the valve driving mechanism provided with the rocker arm with the roller are constituted by the cast iron disclosed the Japanese Patent Publication No. 55-3422, it is difficult to obtain a sufficient pitting resistance property.

SUMMARY OF THE INVENTION

It is therefore object of the present invention to provide a valve driving mechanism having an improved durability.

It is another object of the present invention to provide a valve driving mechanism provided with mechanical parts of an improved pitting resistance property as well as a good wear resistance property.

According to the present invention, the above and other features of the invention can be accomplished in a valve driving mechanism of which a rocker arm is provided at one end portion with a roller brought into a rotative contact with a cam surface of a cam for driving engine valves, by the improvement comprising the cam consisting of 2.0–4.0 wt % of C, 1.5–3.5 wt % of Si, 0.1–1.0 wt % of Mn, 0.005–0.08 wt % of Mg, less than 0.15 wt % of P, less than 0.15 wt % of S, 0.3–1.0 wt % of Cu, 0.03–0.09 wt % of Mo with the balance of Fe, a matrix of the cam being a granular graphite cast iron having a mixed structure of 30–50 vol % of residual austenite structure and a bainite structure. C, Si, Mn and Mg which are included in the cam shaft material are substantially the same rates as those in a ductile cast iron commonly used. P and S are included in the material as a impurity by substantially the same quantity as in the ductile cast iron commonly used. Cu improves a fatigue strength of the material in repeated rolling movements when it is included together with Mo. This effect is too small when a rate of Cu included in the material is less than 0.3 wt % and saturates when more than 1.0 wt %. Thus, Cu is preferably included in the range of 0.3–1.0 wt %. Mo exerts an effect improving hardening property and rolling fatigue strength when it is used together with Cu. This effect is insufficient when the content is less than 0.03 wt %. On the other hand, when more than 0.09 wt %, fine crystalline graphite is produced in boundary portions of eutectic cells so that the rolling fatigue strength is deteriorated. Thus the content of Mo is preferably ranged from 0.03 to 0.09 wt %. In the case where a material includes an austenite structure, the austenite structure is transformed to produce a martensite structure when the cam of the material is brought into contact with the roller so that the wear resistance property as well as the rolling fatigue strength is greatly improved because of an inherent characteristic of the martensite structure. It should however be noted that less than 30 vol % of austenite structure cannot provide the cam material with a desirable effect and makes a secondary machining difficult because of an increase of the hardness of the material after austemper treatment and that more than 50 vol % of the austenite structure is of an insufficient hardness after the austemper treatment resulting in an increase of a wear amount thereof in an initial operation stage and a reduced rolling fatigue strength.

Thus, the rate of the austenite structure in the cam material is preferably ranged from 30 to 50 vol %.

In manufacturing a granular graphite cast iron of a desirable composition in structure as described above, a material is caste at first to produce a blank of the above composition. In turn, the blank is subjected to a annealing treatment to form a ferrite structure thereafter a primary machining. In next, the blank is heated from 850° C. to 950° C. in more than 0.1 hour under a non-oxidizing atmosphere. Thereafter, the blank is subjected to an austemper treatment at a temperature of 365° C. to 400° C. for 0.5–4 hours and at least cam portion of the blank is ground.

The annealing treatment may be applied to the blank in a manner that the blank is heated at a temperature of 850° C. to 950° C. for 0.5–5 hours and maintained at a temperature of 700° C. to 800° C. for 0.5 hours (two stage annealing). The blank may be heated at a temperature of 850° C. to 950° C. for 0.5 to 5 hours and gradually cooled (one stage annealing). The annealing treatment is effected to reduce the deformation and dispersion of the dimension of the blank caused by the austemper treatment. Further the annealing treatment improves a cutting property of the material so that a working cost for forming a hollow structure of workpiece by using a gun drill and the like can be reduced. For this purpose, it is preferable to provide the blank with the ferrite structure of more than 70 vol %.

Following the annealing treatment for forming the ferrite structure, the blank is heated from 850° C. to 950° C. for forming the austenite structure. A residual austenite structure is too small at the heating temperature of less than 850° C. but too much at the temperature of more than 950° C. so that the rolling fatigue strength is rather reduced.

In next, the blank is subjected to the austemper treatment at a temperature from 365° C. to 400° C. When the temperature is less than 365° C., the content of the residual austenite is so small that it is difficult to apply a secondary machining and the rolling fatigue strength is reduced. When the temperature is more than 400° C., both the rolling fatigue strength and the wear-resistance are reduced.

The above and other objects of the present invention will be apparent from the following descriptions of preferred embodiment taking reference to the accompanying drawings.

DESCRIPTION OF PREFERRED EMBODIMENTS

Figure 1:
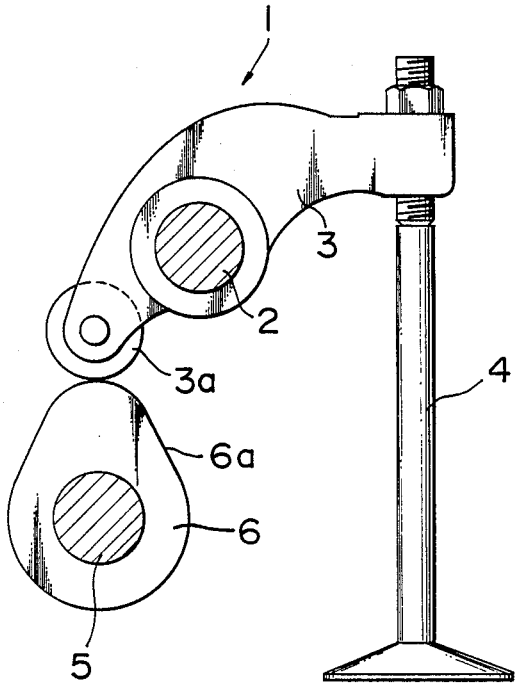
FIG. 1 is a partially sectional view of a valve driving mechanism in accordance with the present invention.

Referring to FIGS. 1, there is shown a valve driving mechanism to which the present invention can be applied.

In FIG. 1, the valve driving mechanism 1 is provided with a rocker arm 3 which is swingably mounted on a rocker shaft 2. The rocker arm 3 is brought into contact with a tip end of a valve stem 4 at one end thereof and engaged with a cam surface 6*a* of a cam 6 formed on a cam shaft 5 at the other end thereof.

Figure 2:
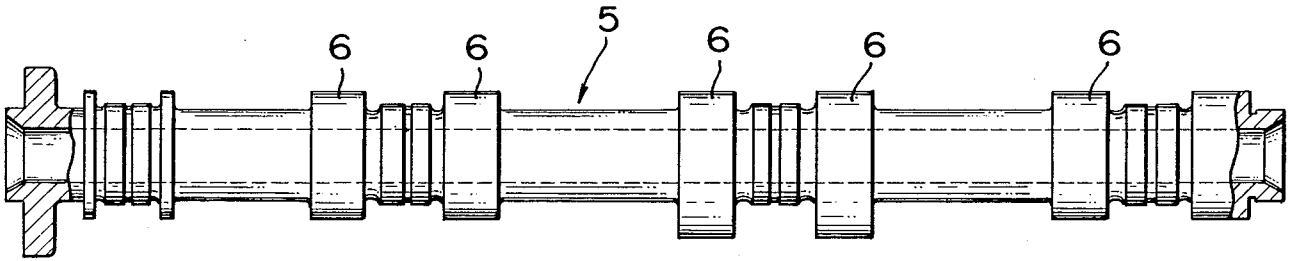
FIG. 2 is an elevation view of a cam shaft in accordance with present invention.

As shown in FIG. 2, the illustrated cam shaft 5 is of a hollow structure and formed with a plurality of cams 6 corresponding to the number of cylinder of an engine.

According to the embodiment as illustrated, examples or specimens of a plural cams are manufactured and tested with regard to physical properties specifically, pitting resistance property and wear resistance property.

The material for the cam specimens according to the present invention are consisted of 2.0–4.0 wt % of C, 1.5–3.5 wt % of Si, 0.1–1.0 wt % of Mn, 0.005–0.08 wt % of Mg, less than 0.15 wt % of P, less than 0.15 wt % of S, 0.3–1.0 wt % of Cu, 0.03–0.09 wt % of Mo with the balance of Fe.

Materials were casted at first to produce blanks satisfying the above limitations for composition. In turn, the blank is subjected to a annealing treatment to form a ferrite structure thereafter a primary machining. In next, the blanks were heated from 850° C. to 950° C. for 0.1 hour under a nonoxidizing atmosphere. Thereafter, the blanks were subjeced to an austemper treatment at a temperature of 365° C. to 400° C. for 0.5–4 hours and at least cam portions of the blanks were ground to manufacture the cam examples.

The cam examples were tested and compared with prior art cams with regard to the durability.

In this durability test, the test cams and a roller constituted by material SUJ 2 consisting of 0.95–1.10 wt % of C, 0.15–0.35 wt % of Si, not more than 0.50 wt % of Mn, not more than 0.025 of P, not more than 0.025 of S, 1.30–1.60 wt % of Cr with balance of Fe and having HRc=60 of Rockwell hardness are contacted with each other and rotated together with. The contact load between the test pieces and the roller were changed. When the rotation number of the roller reaches 10 to the seventh power the test cams were examined with regard to a production of the pitting. In this case, the production of the pitting was detected by a detection of a vibration of the test cams. Vickers hardness Hv of the test cams were measured for evaluating the wear resistance property. Table 1 shows compositions, annealing temperature Tr for forming a ferrite structure, eventually an austenite structure, austemper treatment temperature Tb in the manufacturing process, the result of the pitting resistance test and Vickers hardness as the wear resistance test.

TABLE 1

| | component | | | | | | | | | load | |
|---|---|---|---|---|---|---|---|---|---|---|---|
| | C | Si | Mn | P | Mg | Mo | Cu | Tr(C) | Tb(°C.) | (kg) | Hv |
| Example | | | | | | | | | | | |
| 1 | 3.40 | 2.51 | 0.31 | .028 | .041 | .04 | .50 | 890 | 395 | 720 | 280 |
| 2 | 3.40 | 2.51 | 0.31 | .028 | .041 | .04 | .50 | 890 | 380 | 670 | 290 |
| 3 | 3.40 | 2.51 | 0.31 | .028 | .041 | .04 | .50 | 890 | 370 | 630 | 305 |
| Comparative Example | | | | | | | | | | | |
| 1 | 3.40 | 2.51 | 0.31 | .028 | .041 | .04 | .50 | 890 | 360 | 520 | 330 |
| 2 | 3.50 | 2.61 | 0.35 | .031 | .043 | — | — | 890 | 380 | 470 | 295 |
| 3 | 3.55 | 2.50 | 0.33 | .025 | .040 | — | .80 | 890 | 380 | 540 | 300 |
| Prior art | | | | | | | | | | | |
| | 3.30 | 1.85 | 0.70 | .045 | — | .25 (Cr) | — | — (chilled cam portion) | — | 410 | 520 |

Figure 3:
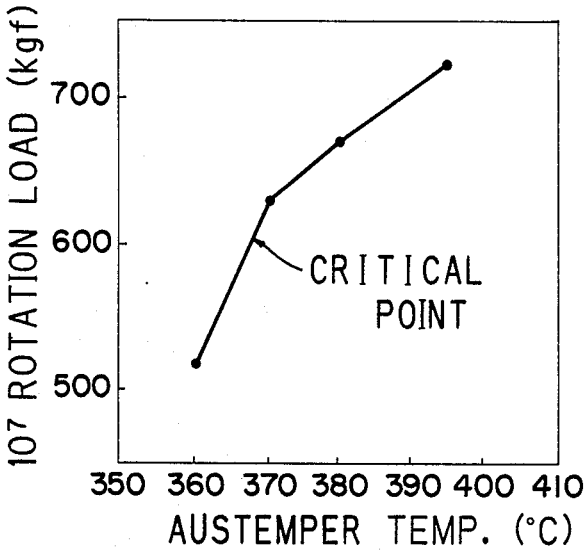
FIG. 3 is a graphical representation showing a relationship between a temperature of austemper treatment and pitting resistance property.
Figure 4:
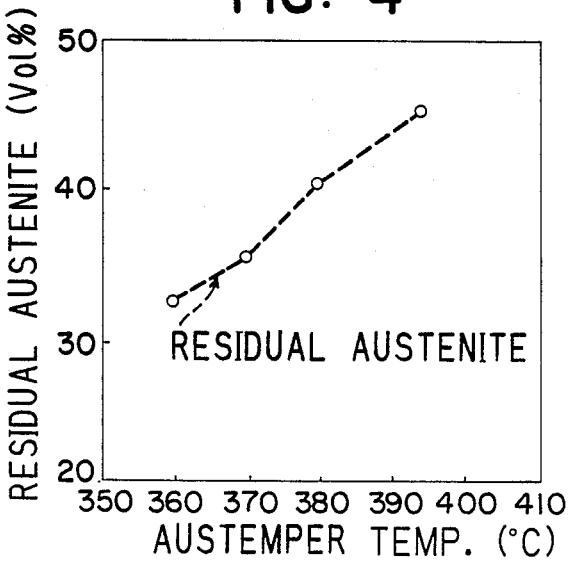
FIG. 4 is a graphical representation showing a relationship between a temperature of austemper treatment and a rate of residual austenite structure.

According to FIG. 3, there is shown a relationship between the austemper treatment temperature Tb and the pitting resistance property and FIG. 4 shows a relationship between the austemper treatment temperature Tb and a rate of the residual austenite structure in the specimens.

According to the result of the tests, the test cams in accordance with the present invention are superior to the prior arts in pitting resistance property and as good property as prior art in wear resistance property. Thus, the present invention can improve the durability of the valve driving mechanism.

As for the roller of the rocker arm, it is preferably constituted by a material of an improved pitting and wear resistance properties such as a carburized steel material.

It will be apparent from the above description that many modifications and variations may be made by those skilled in the art without apart from the scope of the claimed invention as attached.

We claim:

1. In a valve driving mechanism of which a rocker arm is provided at one end portion with a roller brought into a rotative contact with a cam surface of a cam for driving engine valves, the improvement comprising the cam consisting of 2.0–4.0 wt % of C, 1.5–3.5 wt % of Si, 0.1–1.0 wt % of Mn, 0.005–0.08 wt % of Mg, less than 0.15 wt % of P, less than 0.15 wt % of S, 0.3–1.0 wt % of Cu, 0.03–0.09 wt % of Mo with the balance of Fe, a matrix of the cam being a granular graphite cast iron having a mixed structure of 30–50 vol % of residual austenite structure and a bainite structure.

2. A valve driving mechanism in accordance with claim 1 wherein the roller is constituted by a carburized steel material.

3. A valve driving mechanism in accordance with claim 1 wherein C, Si, Mn and Mg included in the cam material are substantially the same rates as those in a ductile cast iron commonly used.

4. A valve driving mechanism in accordance with claim 1 wherein P and S are included in the material as a impurity by substantially the same quantity as in the ductile cast iron commonly used.

* * * * *